United States Patent [19]

Compen et al.

[11] 4,251,749

[45] Feb. 17, 1981

[54] PICTURE DISPLAY TUBE HAVING AN INTERNAL RESISTIVE LAYER

[75] Inventors: Johannes M. A. A. Compen; Reinhart C. W. Eisses; Constantius J. W. Panis; Cornelius J. H. Paridaens, all of Eindhoven, Netherlands

[73] Assignee: U.S. Philips Corporation, New York, N.Y.

[21] Appl. No.: 958,759

[22] Filed: Nov. 8, 1978

Related U.S. Application Data

[63] Continuation of Ser. No. 801,926, May 31, 1977, abandoned.

[30] Foreign Application Priority Data

Jun. 3, 1976 [NL] Netherlands ..... 7605988

[51] Int. Cl.³ ..... H01J 29/88; H01J 31/00

[52] U.S. Cl. ..... 313/479; 313/450

[58] Field of Search ..... 313/450, 479

[56] References Cited

U.S. PATENT DOCUMENTS

| | | | |
|---|---|---|---|
| 2,223,924 | 12/1940 | Stephan | 313/479 X |
| 3,791,546 | 2/1974 | Maley et al. | 313/479 X |
| 4,018,717 | 4/1977 | Francel et al. | 313/479 X |
| 4,041,347 | 8/1977 | Deal et al. | 313/479 X |
| 4,052,641 | 10/1977 | Dominick et al. | 313/479 X |
| 4,092,444 | 5/1978 | Kilichowski | 313/479 X |
| 4,124,540 | 11/1978 | Foreman et al. | 313/479 X |

FOREIGN PATENT DOCUMENTS

| | | | |
|---|---|---|---|
| 2262547 | 7/1973 | Fed. Rep. of Germany | 313/450 |

*Primary Examiner*—Robert Segal

*Attorney, Agent, or Firm*—Algy Tamoshunas

[57] ABSTRACT

A picture display tube comprising an internal resistive layer to restrict the peak current which at the operating potential of the tube is associated with an electrical flash-over possibly occurring therein. The effective part of the resistive layer extends in the neck and over the transition from neck to cone of the envelope of the tube. The resistive layer represents a static resistance value of at most $10^4$ Ohm and a dynamic resistance value of at least 300 Ohm.

5 Claims, 5 Drawing Figures

PICTURE DISPLAY TUBE HAVING AN INTERNAL RESISTIVE LAYER

Figure 1:
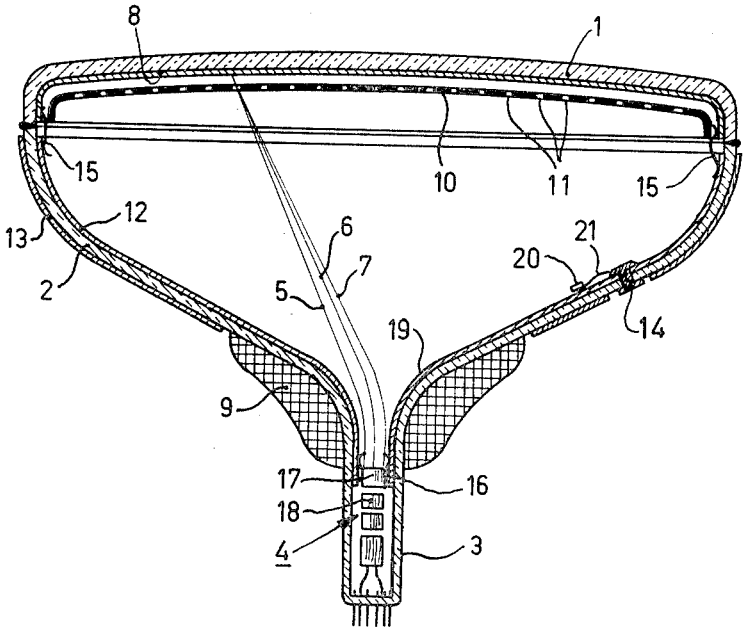

This is a continuation of application Ser. No. 801,926, filed May 31, 1977 now abandoned.

The invention relates to a picture display tube comprising an envelope and having a display screen, an electrode system for generating at least one electron beam directed on the display screen, an electrically conductive layer extending at least between the display screen and the electrode system over the inner surface of the envelope, at least the part of said layer situated near the electrode system consisting of an electrical resistive layer, a high voltage button being situated in the wall of the envelope and being electrically connected to the conductive layer.

The electrodes of the electrode system for generating an electron beam in a picture display tube are often operated at very different voltages. Voltage differences of 20 kV between electrodes which are situated at a short distance from each other are quite usual, particularly in colour display tubes. With such voltage differences, electric flash-overs between the electrodes may occur which, when no special measures are taken, are associated with currents which increase very rapidly in time and can reach values of 500 A and higher. These currents may destroy certain components, in particular semiconductor components, in the electronic circuit of the television receiver via inductive or capacitive coupling, as well as damaging the electrode system itself.

U.S. Pat. No. 2,829,292 discloses a display tube which, in order to limit the detrimental effects of an electric flash-over, is provided with a resistive layer on the interior of the tube envelope of a resistance in the order of $10^6$ Ohm.

It is also known from U.S. Pat. No. 2,545,120 to provide a resistive layer having a resistance of $10^7$ to $10^9$ Ohm in the tube so as to suppress the formation of electric flash-overs.

Although the use of layers having such a high resistance seems favourable from a point of view of circuit safety, such a layer creates other problems. For example, small solid particles may detach from the wall or an element in the tube by impacts or during the transport of the tube. When such a particle lands in the proximity of the electrode system, a strong field emission may occur during operation of the tube in the area of the particle and consequently produce stray radiation which reduces the contrast in the displayed picture. Usually such a particle is destroyed by an electric flash-over produced by the strong field emission. If, however, the resistance of the layer is too high flash-overs may be entirely suppressed and/or the energy thereof may be reduced to a value insufficient to destroy such particles. Similar problems present themselves when in the last phase of the tube manufacturing process electric flash-overs are generated intentionally between those electrodes which are operated at very different voltages in order to burn away from the electrodes possible sources for the formation of flash-overs, for example, burrs or other surface unevenesses.

Furthermore, a switched-on television receiver may be a source of interference for a nearby radio receiver tuned to a transmitter in the long or medium waveband. In a television receiver, the higher harmonics of the line flyback pulse are capacitively coupled to the inner coating of the display tube. A portion of the energy of these harmonics is radiated via the display screen and is partly responsible for the above-mentioned interference. Another part of the interference originates from the video signal itself. The display screen is scanned by an electron beam modulated according to the video signal. When the smoothing effect of the capacitor formed by the inner coating of the tube and the conductive coating provided externally on the tube envelope and connected to the chassis of the television receiver is too small. For example, when one of the coatings has too high an electrical resistance, the display screen potential fluctuates with the amplitude of the video signal. This, also results in an interference signal which is radiated via the display screen.

It has been found that an internal coating with a high resistance is favourable for attenuating the interference caused by the line flyback pulse, whereas an internal coating with low resistance is favourable for attenuating interference caused by the video signal. The attenuation of the interference furthermore depends on the location of the high resistance portion of the conductive layer in the tube.

From the above, it follows that all these aspects should be taken into account in selecting a suitable resistance for the internal resistive layer.

It is an object of the invention to provide a display tube having an internal resistive layer which reduces both the detrimental effects of an electric flash-over and the above-mentioned interference.

According to the invention, a display tube of the kind mentioned in the preamble is characterized in that the resistive part of the conductive layer has a dynamic resistance value of at least about 300 Ohm, while its static resistance does not exceed a value of about $10^4$ Ohm.

The static resistance is defined herein as the quotient of a voltage difference of a few volts set up across the resistance layer and the current consequently flowing through the resistive layer. The dynamic resistance of the resistive layer is defined as the quotient of the operating potential applied to the layer and the peak current occurring as a result of an electric flash-over at the operating potential. The dynamic resistance value is determined by first bringing the electrodes and the internal conductive layer of the tube to operating voltages. An electric flash-over is then initiated in the electrode system and the resultant peak current is measured.

Good results as regards the safety of electronic components in the circuit of the receiver, on the one hand, and the removal of possible loose particles in the display tube by means of an electric flash-over, on the other hand, have been obtained with a resistive layer having a dynamic resistance between about 300 and about 3,000 ohms.

The dynamic resistance of a resistive layer is generally lower than its static resistance. This difference in resistance values proves to be determined mainly by the surface state and the internal structure of the resistive layer. The rougher the surface of the resistive layer, the greater the possibility that sliding sparks are formed across the layer during an electric flash-over. Such sliding sparks should be prevented, however, because they result in a large reduction of the dynamic resistance of the resistive layer and, in addition, result in a non-reproducible variation of an electric flash-over.

In the application of the resistive layer, it is usual to start with a suspension containing, as the main constituents, graphite powder as an electrically readily conductive material, metal oxide powder as an electrically poorly conductive material, alkali metal silicate as an adhesive and water. The static resistance of the layer is determined largely by the layer thickness and the content of silicate, metal oxide and graphite. Furthermore, the resistance of the layer can be influenced by the way in which the layer is fired after drying. When it is fired in air, a certain percentage of graphite will burn, the percentage being dependent on the firing time and temperature.

As stated earlier, the extent to which the dynamic resistance of the layer deviates from its static resistance depends mainly on the surface state and the structure of the layer. The surface state and structure are determined to a considerable extent by the shape and the size of the graphite and metal oxide particles. It has been found that resistive layers, with a dynamic resistance suitable for attaining to the object of the invention, are obtained with metal oxide powder consisting mainly of spherical particles having an average grain size of less than 2 μm and graphite powder consisting of particles whose dimensions are also smaller than 2 μm. The way in which the layer is provided on the wall of the tube also influences on the surface state of the layer. Usually, the part of the layer extending into the neck of the tube is applied by a brush, whereas the part of the layer extending into the cone is usually provided by spraying. However, a layer obtained by brushing generally has a rather rough surface. In addition the reproducibility of the thickness of layers applied by a brush is relatively poor. The active part of the resistive layer within the scope of the invention, however, is in large part restricted to the portion of the layer on the inner surface of the neck and the cone-neck transition. Thus it is the reproducibility and surface state of this portion of the layer that play an important part. In this respect, good results are obtained with a poured resistive layer. A poured resistive layer as used herein is to be understood to mean any resistive layer obtained by causing an excess of suspension to flow along the wall of the tube in any manner. The layers applied in this manner have a thickness of less than 10% and after drying and firing have a surface state suitable for attaining the object of the invention.

Although metal oxides of, for example, vanadium, titanium, zinc, manganese, aluminium, chromium and lead may be used as an electrically poorly conductive material ferric oxide ($Fe_2O_3$) is preferred. The suspensions prepared with such materials are stable; can be readily processed, and give reproducible results with respect to the electrical properties of the layers obtained with this suspension.

An understanding of the electrical behaviour of the resistive layer is seriously impeded by the fact that the static and in particular the dynamic resistance of such a layer is determined by a number of dependent variables. A particular problem is that a variation in the value of for example, one of the variables influences not only the resistance values but also other properties of the layer or the suspension. For example, the silicate content influences not only the static resistance value but also the adhesion and the hardness of the layer. In addition, the silicate content influences the stability of the suspension. It has been found that, taking these aspects into consideration, a suitable compromise is obtained by using a layer comprised largely of 1 part by weight of graphite, 1.5–3 parts by weight of alkali metal silicate and 6–10 parts by weight of ferric oxide.

Figure 2:
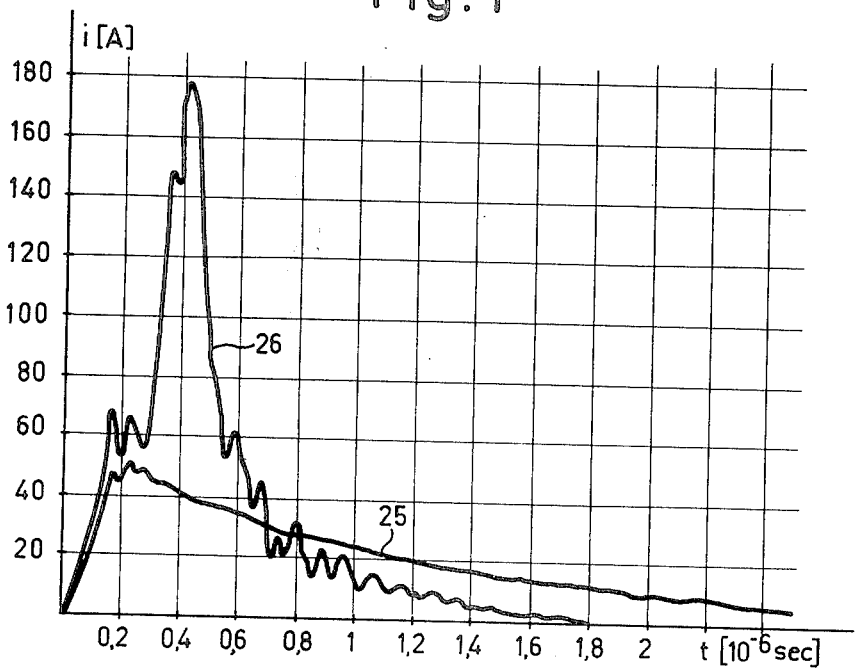
Figure 3:
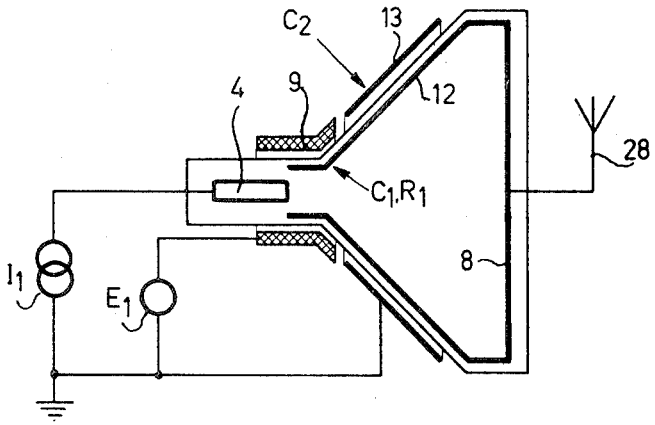
Figure 4:
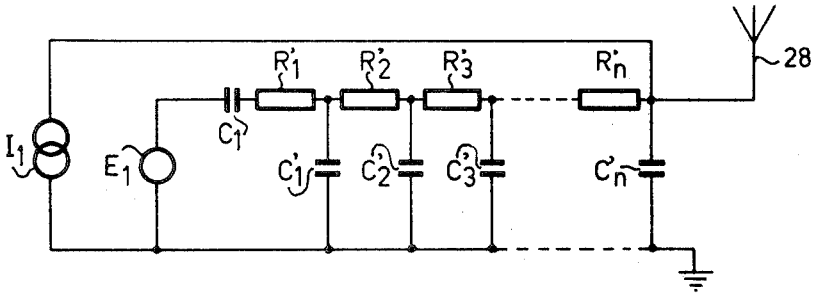
Figure 5:
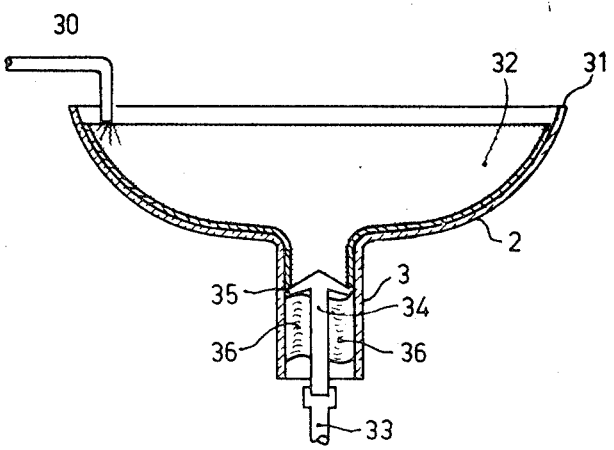

The invention will be described in greater detail with reference to the drawing, in which:

FIG. 1 shows a colour display tube having an internal resistive layer according to the invention, FIG. 2 illustrates the current variation during an electric flash-over for two different resistive layers, FIG. 3 shows diagrammatically in what manner the interference signals originating from the television receiver are radiated, FIG. 4 shows a simplified electric equivalent circuit diagram of the arrangement shown in FIG. 3, and FIG. 5 shows one method for applying the resistive layer shown in FIG. 1.

The tube, which is shown in FIG. 1 in a horizontal cross-sectional view, comprises a glass envelope having a display window 1, a cone 2 and a neck 3. An electrode system 4 for generating three electron beams 5, 6 and 7 is mounted in the neck 3. The electron beams are generated in one plane, the plane of the drawing, and are directed onto a display screen 8 provided on the interior of the display window 1. The display screen is formed by a large number of phosphor strips luminescing in red, green and blue whose longitudinal direction is at right angles to the plane of the drawing. On their way to the display screen 8, the electron beams 5, 6 and are deflected across the display screen 8 by a number of deflection coils 9 arranged coaxially around the tube axis. The beams pass through a colour selection electrode 10 comprising a metal plate having elongate apertures 11, the longitudinal direction of which is also at right angles to the plane of the drawing. The three electron beams 5, 6 and 7 pass through the apertures 11 at a small angle to each other and consequently each impinges only upon phosphor strips of one colour. The tube furthermore comprises an internal conductive layer 12 and an external conductive layer 13. The layer 12 is connected to a high voltage button 14 provided in the tube wall and is furthermore connected, via contact springs 15, to the colour selection electrode 10 and the display screen 8 and, via contact springs 16, to an electrode 17 of the electrode system 4. During operation of the tube, the layer 12 is at an operating potential of approximately 25 kV and the layer 13 is at mass ground potential since it is connected to the chassis of the receiver. The layers 12 and 13, with the glass of the cone 2 therebetween as a dielectric, form a capacitor which serves as a smoothing capacitor for the high voltage. The capacitor discharges when an electrical flash-over occurs in the electrode system 4 between, for example, the electrode 17 and an electrode 18 situated at a small distance therefrom. The peak current associated with the discharge can reach values of 500 A and higher in the case in which the layer 12 has a low resistance. The current pulses may badly damage the semiconductor components in the electronic circuit of the television receiver via inductive or capacitive couplings. In order to limit the amplitude of the current pulse, at least the portion 19 of the layer 12 extending in the tube neck 3 has a relatively large resistance so that the electrode 17 is connected to the high voltage connection 14 via the resistive layer 19. The resistive layer 19 has a dynamic resistance value of approximately 500 ohms and a static resistance value of approximately 2000 ohms. The resistive layer 19 has a thickness of approximately 10 microns and consists substantially of 6 parts by weight of ferric oxide powder of mainly spherical particles having an average grain size of 0.5 microns, 1 part by weight of graphite powder having an average grain size of 1 micron and 2.5 parts by weight of potassium silicate.

As is known, a layer of gettering material of, for example, barium, strontium, calcium or magnesium is deposited on the wall of the tube after the tube is evacuated, so as to getter the residual gases remained in the tube. In conventional display tubes, the holder from which the gettering is released by heating, is connected to the electrode system either directly or by means of a metal strap. This conventional connection method cannot be used in a display tube of the invention because a portion of the gettering material would then be deposited on the resistive layer 19, while in the case of an electric flash-over, sliding sparks would occur along the connecting strap of the holder. An example of a possible connection for the getter holder in which these problems are avoided is shown in FIG. 1. In this figure the getter holder 20 is connected to the high voltage button 14 by means of a connection strap 21. This arrangement prevents the gettering material from being deposited on the resistive portion 19 of the conductive layer 12.

In the display tube described with reference to FIG. 1, an electric flash-over is generated between the electrodes 17 and 18 of the electrode system 4. The variation of the resultant current strength as a function of time can be seen on an oscilloscope. This current variation is shown in FIG. 2 by the curve 25, with time t in units of $10^{-6}$ second being plotted on the horizontal axis and the current strength i in amperes being plotted on the vertical axis. As shown in the figure, the flash-over was associated with a peak current of approximately 50 ampères. From this it follows the dynamic resistance of the layer 19 at the given high voltage of 25 kV is approximately 500 ohms. Analogously, the curve 26 shows the variation of the current strength during an electrical flash-over in another similar display tube. The second display tube was also operated at a high voltage of 25 kV and was provided with an internal resistive layer having a static resistance value of approximately 2000 ohms. The dimensions of the graphite particles and iron oxide particles of the layer, however, were larger than 2 microns so that during electrical flash-over sliding sparks occurred over the layer. The effect of the sliding sparks on the dynamic resistance value of the layer clearly appears from the variation of the curve 26. From the peak current of approximately 180 ampères and the given high voltage of 25 kV, it follows that the dynamic resistance of the layer is only approximately 140 ohms. Furthermore it is striking that the curve 26 as compared with the curve 25 has an irregular variation which is in agreement with the non-reproducible variation of a flash-over associated with sliding sparks.

An explanation of the way in which interference signals are radiated by a television receiver is given with reference to FIGS. 3 and 4. FIG. 4 shows a simplified equivalent circuit diagram of the arrangement shown in FIG. 3. In these figures, $C_1$ is the capacity between the deflection coils 9 and the inner coating 12 of the tube ($C_1 \approx 150$ pF); $C_2$ is the capacity formed by the inner coating 12 and the outer coating 13

$$(C_2 = \sum_{j=1}^{n} C_j' \approx 2000 \text{ pF})$$

and $R_1$ is the static resistance of the inner coating 12

$$(R_1 = \sum_{i=1}^{n} R_i').$$

With a switched-on television receiver, the display screen acts as an antenna which is shown diagrammatically in FIGS. 3 and 4 by the antenna 28. The current source $I_1$ and the voltage source $E_1$ are the video generator and the deflection generator of the receiver, respectively. From FIG. 4 it follows that in order to reduce an interference signal resulting from the video signal generated by the generator $I_1$, the smoothing effect of the capacitor $C_2$ formed by the inner coating 12 and the outer coating 13 should be as large as possible. In the ladder network $R'_i$, $C'_j$ the resistors $R'_i$ in the direction towards the display screen (with i increasing) should then be as small as possible. In order to reduce the interference signal resulting from the line flyback pulse generated by the generator $E_1$, the resistors $R'_i$, however, should be as large as possible so as to obtain a large attenuation of the signal. According to the circuit arrangement shown in FIG. 4, these conditions are fulfilled when $R'_i=0$ for $i \geqq 2$ and $R'_1 \approx R_1$. It is thus desirable to limit the resistive layer with the resistance value $R_1$ to the portion of the inner coating 12 extending in the neck of the tube and to make the remaining portion of the layer as conductive as possible.

A low-resistance and a high resistance portion of the inner coating 12 can be obtained by providing on the tube wall two layers of different composition. It has been found in practice, however, that one layer will suffice. As a matter of fact, the static resistance value of the resistive layer increases proportionally with the diameter of the cone, while in addition the gettering metal released from the getter holder 20 deposits on the strongly widening part of the cone and short-circuits the resistive layer in that region. The above-defined static resistance, thus, is mainly equal to the resistance of the resistive layer in the neck of the tube. This resistance is measured between a point situated at the level of the contact point of the spring 16 with the layer 19 and a point situated at the level of the neck-cone transition (FIG. 1).

The way in which the inner wall of the cone 2 is covered with a resistive layer is shown in FIG. 5. A suspension consisting of 18 parts by weight of water, 5 parts by weight of ferric oxide, 1 part by weight of graphite and 10 parts by weight of potassium silicate consisting of a 20% solution of $K_2O$ and $SiO_2$ in the ratio 1:3.5, is poured on the inner surface of the cone 2 through a supply pipe 30. In order to obtain a uniform coating of the cone 2, the outflow aperture of the pipe 30 is moved along the edge 31 of the cone until the initial position has been reached again. The excess suspension is drained via the neck 3 of the tube and can be received in a container. The thickness of the layer 32 remaining on the surface of the cone 2 is determined by the rheological properties of the suspension. The suspension behaves as a "Bingham fluid," which means that the shearing strength therein should reach a given value, i.e. yield value, before the suspension starts flowing. The yield value can be adjusted to the desired value by certain additions to the suspension. An additive suitable for that purpose consists, for example, of 0.1 part by weight of polyvinyl pyrrolidon, by which also improves the stability of the suspension. A layer thickness suitable for the resistive layer 32 is between 5 and 20 microns.

After pouring the suspension on the cone, a sharp boundary of the resistive layer 32 in the neck 3 should be provided. This may be accomplished by a spray head 34 mounted on a pipe 33 inserted into the neck 3, after which deionised water is supplied via the pipe 33. The spray head has radial outflow apertures 35 which direct the emitting jets of water onto the inner wall of the neck 3. The spray head 34 is rotated about its longitudinal axis and the neck of the tube is wiped clean by means of two rubber wiper blades 36 mounted on the spray head 34. After the portion of the neck on which no coating is desired has thus been thoroughly clean and simultaneously the resistive layer 32 dried, the cone is maintained at a temperature of approximately 450° C. for approximately one hour so as to thermally harden the layer 32. A small part of the graphite burns so that a slightly smaller amount of graphite is present in the suspension with respect to the iron oxide in the fired layer.

Combined with the firing treatment, the display window 1 can be secured to the cone 2 by means of a sealing glass, after which the tube may be assembled in the usual manner.

Although the invention has been explained with reference to a colour television display tube, it may be used in any other type of display tube. When the display window and the cone are sealed together prior to the provision of the internal resistive layer, as would generally be the case for black-and-white display tubes, the suspension cannot be provided in the manner shown in FIG. 5. In that case, the tube with its neck lowermost can be placed in a container filled with the suspension. The tube can be de-aerated via a pipe introduced at the open end of the neck of the tube, the level of the suspension in the tube rising. When the desired level in the tube has been reached, the suspension is again drained via the neck of the tube while leaving a thin layer of suspension on the inner wall of the tube. The boundary of the layer in the neck of the tube can be obtained in the above-described manner.

Furthermore the invention is not restricted to tubes in which the electrode system in the neck is connected to the resistive layer by means of contact springs. The invention may also be used in tubes in which the electrode system is arranged so as to be fully isolated from the resistive layer in the neck of the tube, for example, tubes in which the part of the layer extending in the neck of the tube also constitutes an accelerating electrode. As a matter of fact, electrical flash-overs in that case may occur between the resistive layer and an electrode of the electrode system.

What is claimed is:

1. A picture display tube comprising an envelope having a display screen, an electrode system mounted in said envelope for generating at least one electron beam directed onto said screen, a resistive layer poured on at least a portion of the interior surface of said envelope near said electrode system, said layer having a dynamic resistance of at least 300 ohms, a static resistance less than 10,000 ohms and comprising a mixture of graphite particles having an average size less than 2 microns and generally spherical ferric oxide particles having an average size less than 2 microns, and means for electrically connecting said layer to a source of high voltage.

2. The picture tube according to claim 1 wherein said dynamic resistance of said resistive layer is between 300 and 3,000 ohms.

3. The display tube according to claim 1 wherein said mixture includes an alkaki metal silicate.

4. The display tube according to claim 1 wherein the thickness of said layer is between 5 and 20 microns.

5. The display tube according to claim 4 wherein said mixture consists essentially of one part by weight of graphite, 1.5 to 3 parts by weight of alkali metal silicate and 6 to 10 parts by weight of ferric oxide.

* * * * *